United States Patent [19]

Harvey

[11] 4,019,935

[45] Apr. 26, 1977

[54] AUTOMATIC FEEDING OF LABELS FOR APPLICATION TO BOTTLES OR OTHER CONTAINERS

[75] Inventor: Albert J. Harvey, Detroit, Mich.

[73] Assignee: Diamond International Corporation, New York, N.Y.

[22] Filed: May 14, 1975

[21] Appl. No.: 577,178

[52] U.S. Cl. ..... 156/64; 156/361; 226/45

[51] Int. Cl.[2] ..... B65C 1/00

[58] Field of Search ..... 156/361, 350, 351, 366, 156/367, 378, DIG. 46, 540–542, 553, 64; 226/24, 32–33, 45, 115, 124, 136, 156, 174, 181; 250/211 K

[56] References Cited

UNITED STATES PATENTS

| | | | |
|---|---|---|---|
| 2,033,857 | 3/1936 | Smith et al. | 226/32 |
| 2,418,545 | 4/1947 | Zimmerman | 226/176 X |
| 2,745,663 | 5/1956 | Hamilton et al. | 226/194 X |
| 2,877,586 | 3/1959 | Chenery et al. | 156/361 X |
| 2,889,648 | 6/1959 | Richter | 156/361 X |
| 2,920,780 | 1/1960 | Hauschild et al. | 156/361 |
| 3,403,066 | 9/1968 | Ikelheimer | 226/124 X |
| 3,649,840 | 3/1972 | Thorn et al. | 250/211 K X |
| 3,713,571 | 1/1973 | Simonton | 226/32 X |
| 3,721,601 | 3/1973 | Pituch et al. | 156/361 X |
| 3,813,268 | 5/1974 | Kerwin | 156/361 X |

*Primary Examiner*—David A. Simmons
*Attorney, Agent, or Firm*—Karl W. Flocks

[57] ABSTRACT

A web with labels thereon passes from a feed roll to a take-up reel for application of the labels to bottles in register with the bottles, by means of adjustable photoelectric means to detect index or register marks on the label web and move the web by controlled metering and shuttle movement.

13 Claims, 9 Drawing Figures

AUTOMATIC FEEDING OF LABELS FOR APPLICATION TO BOTTLES OR OTHER CONTAINERS

BACKROUND OF THE INVENTION

The present invention refers to the automatic application of labels to bottles or other containers and more particularly refers to the indexing of labels on a web passing bottles in turn wherein the labels are removed from the web, by heat in the illustrated embodiment, and applied to the bottles while the web continues to a take-up reel.

In such an operation it is important that each label be applied over a specific predetermined part of the surface of the bottle, especially in the case of plastic bottles where a seam in the bottle usually must be avoided for smooth results.

In the prior art, in order to obtain an exact register between labels and bottles use is made of rollers with sprockets which necessitates the use of label webs with spaced holes along their edges and gear changes whenever a change in label size is made. This may also necessitate additional gearing to coordinate operation of different parts of the machine.

SUMMARY OF THE INVENTION

The present invention allows the more economical production of labels for application by heat transfer or similar methods to bottles or other containers.

Furthermore the apparatus of the present invention allows easy adjustment for changes in label size without gear replacement for every label width change or other replacement of portions of the apparatus.

Also, the apparatus of the present invention allows the use of labels with indexing placed thereon during the printing of the label without requiring printing registration with sprocket holes.

Accordingly, the present invention utilizes photoelectric cell means to control the movement of labels on a web material into registration with bottles to which the labels are to be applied with means for adjustment of large or small distances between index or registration marks on the labels or on the web, and adjustment of sensitivity to insure detection of the marks.

Also, the apparatus of the present invention is easily adjustable to retain proper web tension to insure smooth movement of the label web throughout the apparatus from the feed roll to the take-up roll.

BRIEF DESCRIPTION OF THE DRAWINGS

These as well as further advantages which are inherent in the invention will become apparent from the following description, reference being had to the accompanying drawings wherein.

DESCRIPTION OF THE PREFERRED EMBODIMENT

Figure 1:
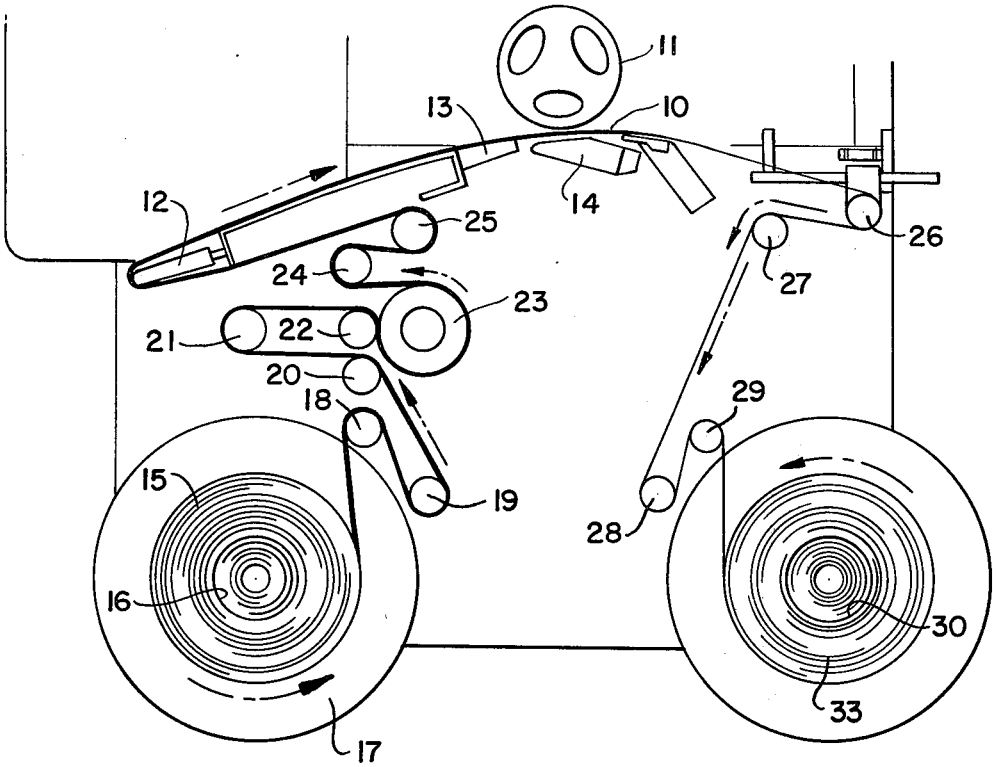
FIG. 1 is a diagrammatic top plan view of the threading of the label web in the apparatus of the present invention.

Referring first to the label web 10 threading diagram of FIG. 1, there is shown turret 11 to which bottles or similar containers, usually of plastic material, are delivered and afterwards removed by conveyors (not shown). Label web 10 to which labels are affixed is passed by turret 11 after heating by preheater 12 and heater 13, and when in proper register with the side of a bottle on turret 11 is pressed against the bottle and permanently affixed thereto by presser 14. It is the remainder of the mechanism shown which insures this proper registration between labels on label web 10 and the surface of the bottles on turret 11.

A roll of labels 15 is placed on a spindle 16 and rotating platform 17 from which the web 10 with labels affixed thereto is threaded so as to change directions around rolls 18 and 19 respectively and then idler roller 20, movable roller 21, pinch roll 22, metering roll 23 and then around rolls 24 and 25 to preheater 12. Label web 10 passes heater 13 and after the label is removed from web 10 at the point where the web 10 passes between presser 14 and turret 11, label web 10 without labels is threaded around web shuttle roller 26 with web 10 changing directions around rolls 27, 28 and 29 and winding around take-up reel spindle 30.

Figure 2:
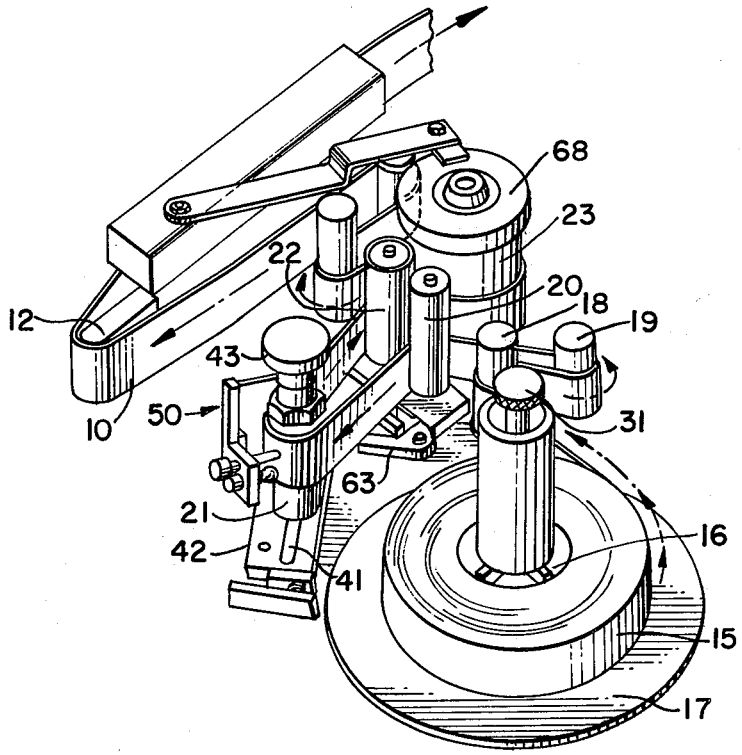
FIG. 2 is a partial perspective view of the apparatus as viewed from the left side of FIG. 1.

FIG. 2 shows in perspective the machanism determining the portion of the path of label web 10 between the feed roll of labels 15 on spindle 16 to a point past preheater 12. Spindle 16 is adjustable through feed roll elevation knob 31 so as to elevate roll of labels 15 for proper height relative to the bottles on turret 11. Passing around rolls 18 and 19, and idler 20, label web 10 reaches and threads around movable roller 21.

Figure 3:
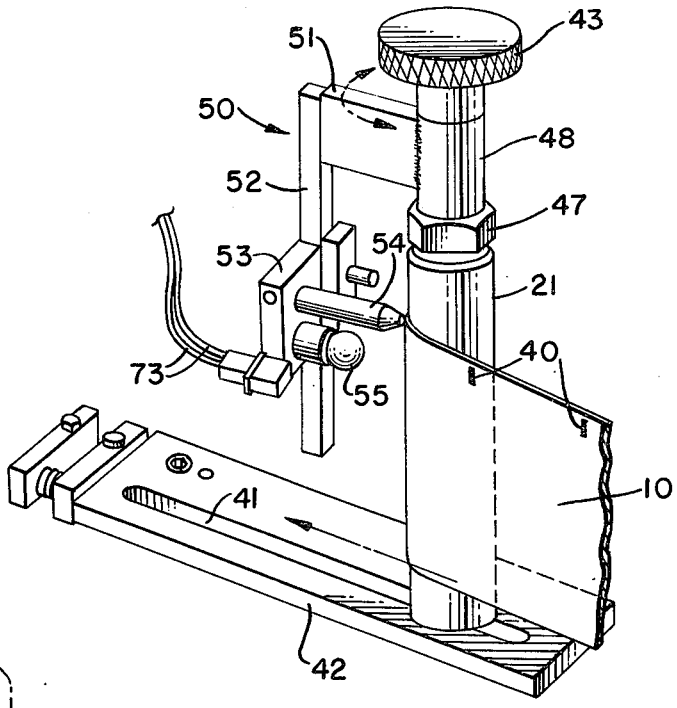
FIG. 3 is an enlarged perspective view of a movable roller and photoelectric cell attachment shown in FIG. 2.
Figure 4:
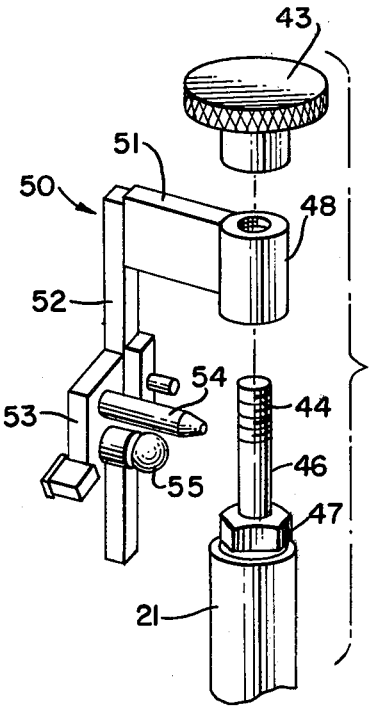
FIG. 4 is an exploded perspective view of the upper portion of the device of FIG. 3.

Movable roller 21 and the parts connected thereto are shown enlarged and in more detail in FIGS. 3 and 4. Label web 10 with register marks 40 along an edge threads around movable roller 21, so called because it can be moved for purposes of adjustment along a linear slot 41 in base place 42. When there is a change in size in labels used, and the spacing between register marks 40 on label web 10 has been greatly altered, a change in position of movable roller 21 along slot 41 is usually necessary. In such case tension on web 10 is loosened by some unwinding of feed roll 15. Hand knob 43 is loosened on threads 44 on movable roller shaft 46. Hex nut 47 is then loosened allowing the sliding of movable roller 21 until a label on web 10 is in an approximate position to register with a bottle on turret 11. Hex nut 47 and hand knob 43 are then retightened.

On movable roller shaft 46 between hand knob 43 and hex nut 47 is a coller 48 to which is attached photocell bracket 50. Bracket 50 has a horizontal arm 51 attached to collar 48 and a vertical member 52 attached to horizontal arm 51. A vertically movable plate 53 is slidably mounted on vertical member 52 and can be firmly held in a set position on vertical member 52. This allows vertical adjustment of pointer 54 containing a photocell, and bulb 55, so as to align photocell pointer 54 at the correct height to detect register marks 40 on labels on label web 10.

The movable roller 21 is moved in linear slot 41 for coarse positioning of the labels in relation to the bottles as previously described. For further fine adjustment, hand knob 43 is loosened thereby allowing collar 48 to rotate on shaft 46 and rotate photocell pointer 54 until the exact desired position of the label on the bottle is obtained. The height and pointer rotation adjustments may be made while the machine is operating since these adjustments, unlike the movement of roller 21 in slot 41, do not involve changes in tension of web 10 during adjustment.

From movable roller 21, label web 10 is threaded between pinch roll 22 and metering roll 23, and changes direction around rolls 24 and 25 respectively to pass over preheater 12 and heater 13.

Figure 5:
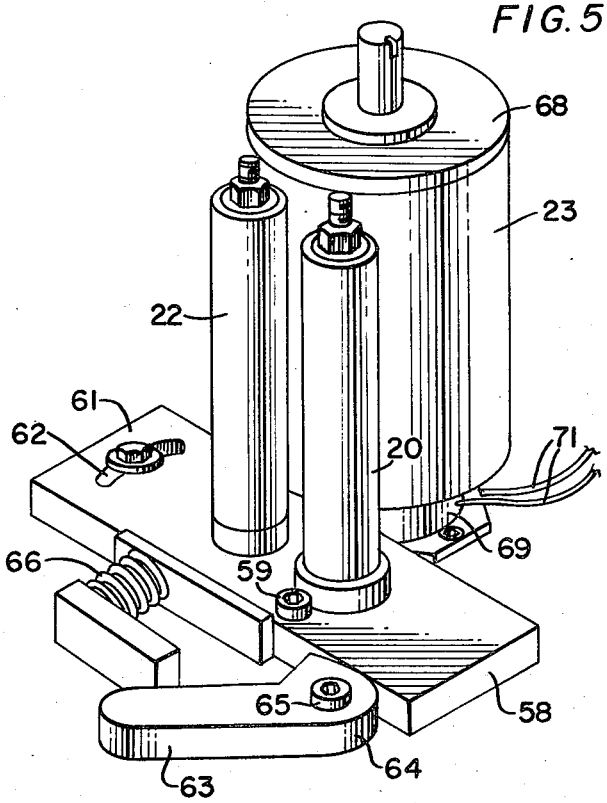
FIG. 5 is an enlarged perspective view of a metering roll and associated pinch roll and idler roll mechanism shown in FIG. 2.

FIG. 5 shows enlarged details of the pinch roll 22–idler roller 20 assembly and metering roll 23, previously shown with adjacent apparatus and connected label web 10 in FIG. 2. Pinch roll 22 and idler roller 20 are both mounted for rotation on baseplate 58 which pivots about pivot bolt 59 guided by a guide bolt 61 extending through arcuate slot 62. Pinch roll 22 is adjusted to press against metering roll 23 by loosening guide bolt 61 and through movement of control lever 63 having a cam shaped end 64 which pivots about pivot 65, opposing the force of spring 66 around pivot bolt 59. When there is proper pressure of pinch roll 22 against metering roll 23, guide bolt 61 is tightened.

Metering roll 23 has an electrical clutch 68 and electrical brake 69 with connections to electrical box 70 (FIG. 6) through wires 71. A cable 72 from electrical box 70 besides connecting to wires 71 also connects to wires 73 connected to photocell pointer 54 and bulb 55. From metering roll 23 the label web 10 is metered out controlled by electrical brake 69 which in turn is controlled by photocell pointer 54 and a timing switch assembly 75, to be explained, through electrical box 70.

Figure 6:
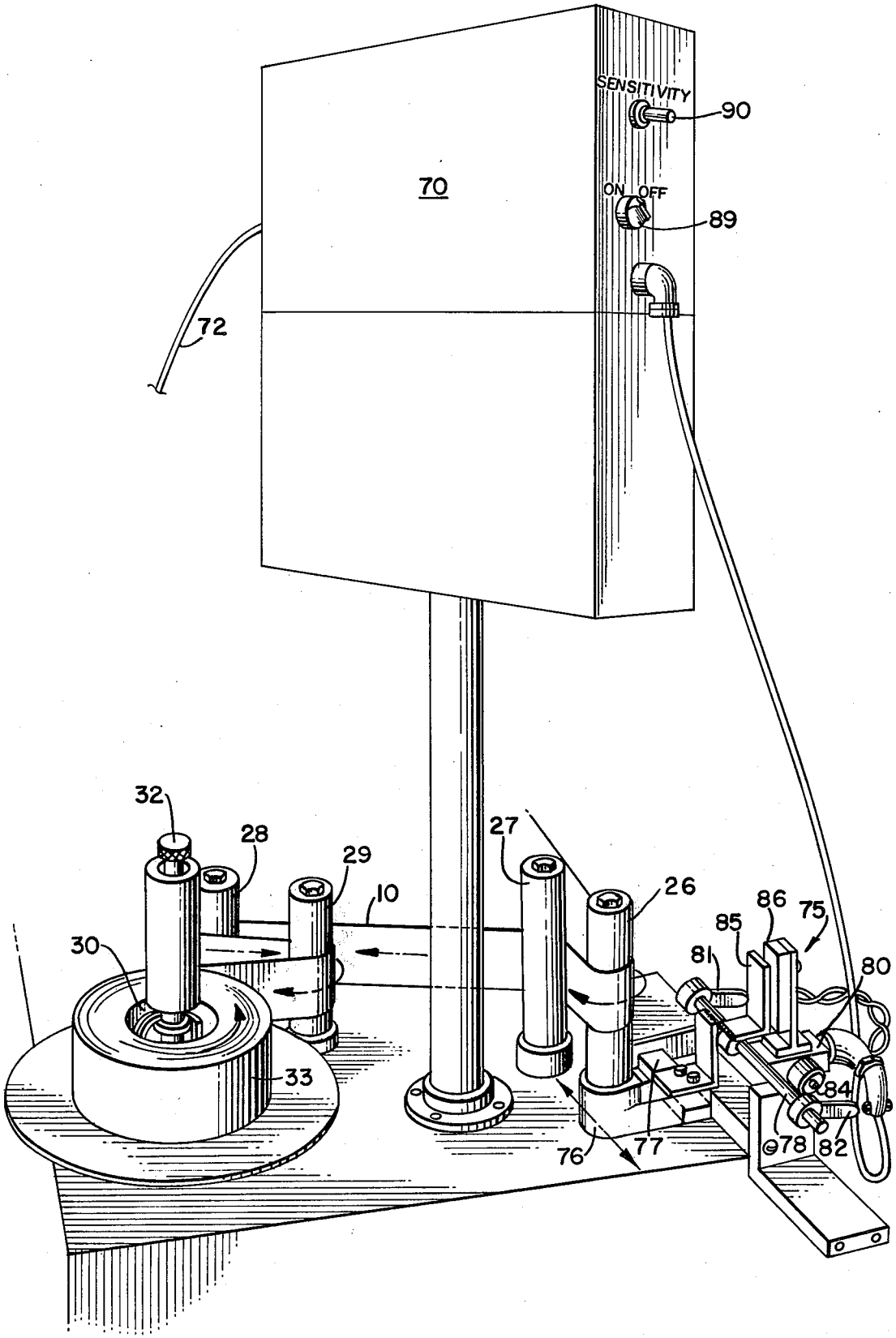
FIG. 6 is a partial perspective view of the apparatus as viewed from the right side of FIG. 1.
Figure 7:
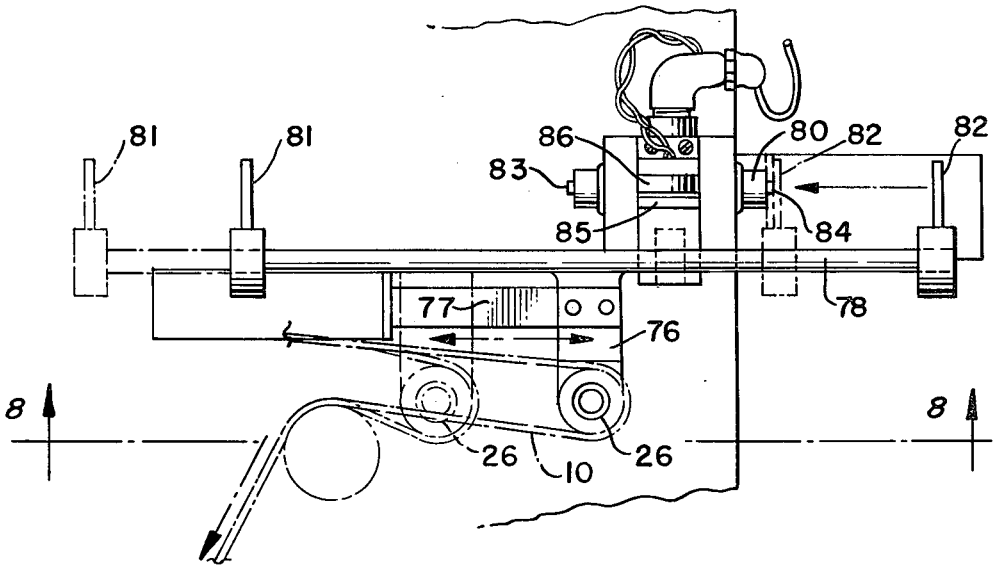
FIG. 7 is an enlarged top plan view of the timing switch assembly shown in FIG. 6.
Figure 8:
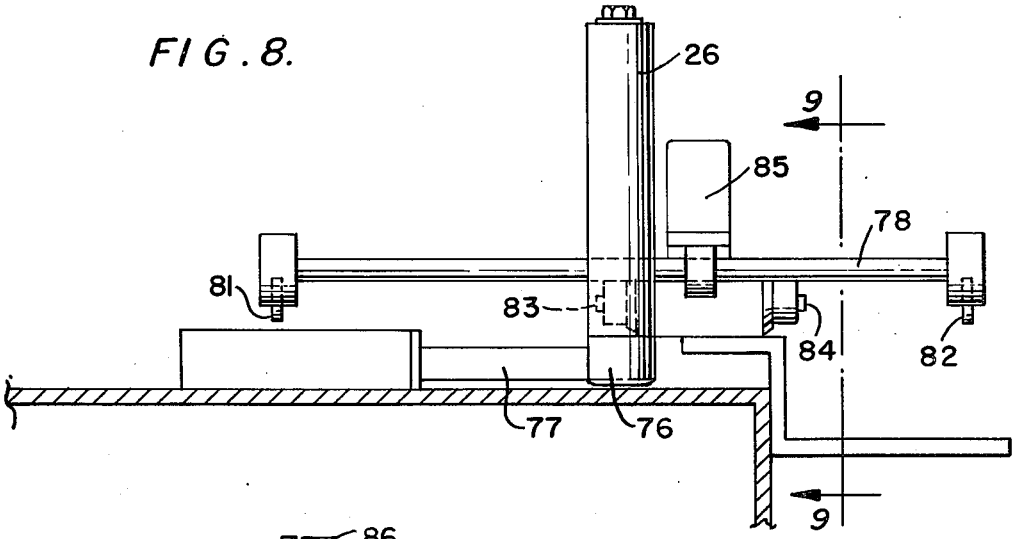
FIG. 8 is an elevational view taken along line 8—8 in FIG. 7.
Figure 9:
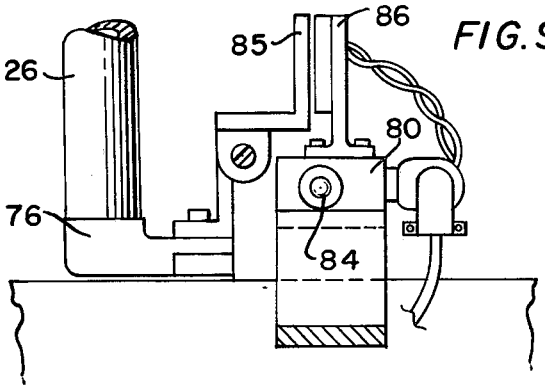
FIG. 9 is a side elevational view taken along line 9—9 in FIG. 8.

Such a timing switch assembly 75 is shown in FIG. 6 with portions of the apparatus through which label web 10 is threaded after the labels are removed from web 10 and affixed to bottles on turret 11. Assembly 75 with web shuttle 76 are also shown enlarged in the views in FIGS. 7, 8 and 9.

Label web 10 after passing between presser 14 and the bottles on turret 11 is threaded partially around web shuttle roller 26, followed by rolls 27, 28 and 29 and on to take-up reel spindle 30. A take-up reel elevation knob 32, similar to feed roll elevation knob 31, is used to adjust the elevation of the take-up roll 33 on take-up reel spindle 30.

Web shuttle roller 26 is mounted for reciprocation on web shuttle 76 so as to move the label web 10 the correct distance for the width of a label to be applied to a bottle. Web shuttle 76 is moved by mechanical means, not shown, moving arm 77 outward (to the right in FIGS. 7 and 8) to the solid line position in FIG. 7 to advance the label web 10. Movable roller 21 is also mechanically connected through its base to web shuttle 76.

Web shuttle 76 has shaft 78 connected for movement therewith and trigger fingers 81 and 82 extending therefrom near opposite ends of shaft 78. Timing switch 80 has pushbuttons 83 and 84 positioned to be contacted by trigger fingers 81 and 82 respectively to alternate end positions of reciprocation of shaft 78 and web shuttle 76, and roller 26 reciprocating therewith. Also mounted on web shuttle 76 is flag 85 which passes and activates proximity switch 86 at the end of each return stroke to enable photocell in pointer 54 to detect next the register mark 40. Trigger fingers 81 and 82 are set so as to press a respective pushbutton 83 and 84 at the ends of each direction of reciprocation of web shuttle 76 and to allow travel of label web 10 on web shuttle roller 26 the proper distance for positioning a label for the width of the label on a bottle on turret 11. The pushbuttons 83 and 84 are connected to engage clutch 68 and turn metering roll 23 to accurately synchronize label motion through connections to electrical box 70 and to the mechanical motion of the web suttle 76, and the photocell in pointer 54 which when detecting the register mark 40 engages brake 69, thus accurately positions the label relative to an article being labeled with every reciprocation of the web shuttle 76.

With all adjustments made as discussed above, there is an additional sensitivity adjustment. With switch 89 in the "on" position, adjustment is made of the sensitivity control 90 so as to detect register marks 40 at photocell pointer 54 and stop the label web 10 at each mark 40 in succession. Sensitivity adjustment is made to allow for variation of the thickness of the register mark 40 on label web 10 and for the color of the mark 40, the photocell being more sensitive and thus requiring less sensitivity to a black line than for a light colored blue line. By such adjustment for color a label printed on one color can have the register mark printed in that color and adjustment with sensitivity control 90 to operate the apparatus without necessitating additional printing for a black register mark 40.

It will be obvious to those skilled in the art that various changes may be made without departing from the scope of the invention and the invention is not to be considered limited to what is shown in the drawings and described in the specification.

What is claimed is:

1. Apparatus for indexing of labels on a label web for movement of the web in register with bottles or the like moved to receive the labels and have them affixed thereto comprising a label web having register marks thereon and connected between a feed means and a take-up means;

means to detect said register marks, positioned along the path of said label web;

means to move said label web, and stop said label web upon detection of each said register mark, positioned along the path of said label web; and means along the path of said label web to apply labels from said label web to bottles or the like;

said detecting means including a roller with a shaft therethrough having said label web pass at least partially around said detecting means roller, and photoelectric means adjustably mounted on said roller having a light source and a detection photocell adjacently mounted on the same side of said web.

2. The apparatus of claim 1, further characterized by said photoelectric means including a bracket mounted on said detecting means roller shaft by collar means around said shaft, and photocell means attached on said bracket adjustably mounted for movement along the axial direction of said detecting means roller.

3. Apparatus for indexing of labels on a label web for movement of the web in register with bottles or the like moved to receive the labels and have them affixed thereto comprising a label web having register marks thereon and connected between a feed means and a take-up means;

means to detect said register marks, positioned along the path of said label web;

means to move said label web, and stop said label web upon detection of each said register mark, positioned along the path of said label web; and means along the path of said label web to apply labels from said label web to bottles or the like;

a metering means to meter out said label web including a metering roll around which said label web passes at least partially, braking means on said metering roll, and a pinch roll assembly adjacent said metering roll and having a pinch roll located for pressing contact with said metering roll.

4. The apparatus of claim 3, further characterized by said pinch roll assembly including a movable base having an arcuate slot therein and pivotally mounted with a pivot bolt, an idler roller and said pinch roll mounted for rotation on said movable pinch roll assembly base, cam means and spring means pressing against said pinch roller assembly base and positioned relative to said pivot bolt to produce opposing forces around said pivot bolt, and guide means in said arcuate slot to tighten said base in position for pressing said pinch roll against said metering roll.

5. Apparatus for indexing of labels on a label web for movement of the web in register with bottles or the like moved to receive the labels and have them affixed thereto comprising a label web having register marks thereon and connected between a feed means and a take-up means;

means to detect said register marks positioned along the path of said label web;

means to move said label web, and stop said label web upon detection of each said register mark, positioned along the path of said label web; and means along the path of said label web to apply labels from said label web to bottles or the like;

said moving and stopping means including web shuttling means having controlled reciprocating movement, and a web shuttle roller mounted on said web shuttling means for movement therewith with said label web passing at least partially around said shuttle roller;

said moving and stopping means further including a timing switch assembly including a timing switch with switch buttons extending in opposite directions, a proximity switch, a flag mounted for movement with said web shuttling means past and in close proximity for operation of said proximity switch, and a pair of trigger fingers mounted for movement with said web shuttling means and on opposite sides of said timing switch for contact of one of said trigger fingers with one of said switch buttons at one end of the reciprocating movement of said web shuttling means and contact of the other of said trigger fingers with the other of said switch buttons at the other end of the reciprocating movement of said web shuttling means.

6. The apparatus of claim 1, further characterized by sensitivity control means to adjust the sensitivity of said detecting means for variations in line thickness and color in said register marks of said label web.

7. Apparatus for indexing of labels on a label web for movement of the web relative to bottles or the like to which the labels are to be affixed comprising a label web having register marks printed thereon and connected between a feed means and a take-up means;

metering means to feed said labels on said label web to an application station for applying labels on the bottles or the like;

said label web also threaded past means to detect said register marks, and means to move said label web, and stop said label web upon detection of each said register marks;

said detecting means including coarse adjustment means and fine adjustment means for positioning of the stopping point for each of said register marks;

said moving and stopping means including reciprocally adjustable web shuttling means to move said label web predetermined amounts relative to the bottles or the like.

8. Apparatus for indexing of labels on a label web for movement of the web relative to bottles or the like to which the labels are to be affixed comprising a label web having register marks printed thereon and connected between a feed means and a take-up means;

said label web threaded past means to detect said register marks, and means to move said label web, and stop said label web upon detection of each said register marks;

said detecting means including coarse adjustment means and fine adjustment means for positioning of the stopping point for each of said register marks;

said moving and stopping means including reciprocally adjustable web shuttling means to move said label web predetermined amounts relative to the bottles or the like;

said detecting means including a roller and photoelectric means, said course adjustment means including means to position said roller along a predetermined linear direction, said fine adjustment means including means to position said photoelectric means concentrically relative to said roller.

9. The apparatus of claim 8, further characterized by said photoelectric means also adjustable along a line parallel to the axis of rotation of said roller.

10. A method of indexing labels for application to bottles or the like comprising the steps of moving the labels on a label web which web is moved between a feed roll and a take-up roll;

detecting register marks printed on said label web of labels at spaced intervals;

metering the feed of the labels to an application station for applying the labels;

moving said label web by reciprocal motion means imparting a start and stop motion to said label web controlled by said detecting means.

11. The method of claim 10, further characterized by adjusting the detecting sensitivity to the thickness and color of said register marks.

12. The method of claim 11, further characterized by the step of pressing the label on said label web against said bottles or the like and applying heat thereto.

13. Apparatus for indexing of labels on a label web for movement of the web in register with bottles or the like moved to receive the labels and have them affixed thereto comprising a label web having register marks thereon and connected between a feed means and a take-up means;

means to detect said register marks, positioned along the path of said label web;

means to move said label web, and stop said label web upon detection of each said register mark, positioned along the path of said label web; and means along the path of said label web to apply labels from said label web to bottles or the like;

said detecting means including a roller with a shaft therethrough having said label web pass at least partially around said detecting means roller, photoelectric means adjustably mounted on said roller, and means to reposition said detecting means roller linearly including a base having a slot therein to receive said shaft of said detecting means roller, and screw means on said shaft to tighten said shaft in said slot.

* * * * *